United States Patent [19]

McDonald

[11] 3,991,695

[45] Nov. 16, 1976

[54] WATERCRAFT DOCKING

[76] Inventor: Frank W. McDonald, 4420 Choctaw Circle SE., Huntsville, Ala. 35801

[22] Filed: Jan. 8, 1976

[21] Appl. No.: 647,589

[52] U.S. Cl. ..... 114/45; 61/65

[51] Int. Cl.[2] ..... B63C 1/02; B63C 1/06

[58] Field of Search ..... 114/45–48, 114/5 BD; 61/64–67; 114/.5 BD

[56] References Cited

UNITED STATES PATENTS

| | | | |
|---|---|---|---|
| 3,406,649 | 10/1968 | Burkhart | 114/45 |
| 3,603,276 | 9/1971 | De Lisle | 114/45 |
| 3,777,691 | 12/1973 | Beale | 114/48 |
| 3,857,248 | 12/1974 | Rutter | 114/45 |

*Primary Examiner*—Trygve M. Blix
*Assistant Examiner*—Stuart M. Goldstein

[57] ABSTRACT

The invention described and disclosed herein is a dry dock for boats which consists of a frame, formed supports for the boat hull, guides used in docking and lateral support for the docked boat, air bladders to provide flotation, air control valves with an air-line system, and guides to restrain the dry dock to a stall in a marina. The dry dock provides a dry stowage of the boat, which is free from ice damage during the winter season and a means of effecting hull and propeller maintenance without beaching the vehicle or using heavy-duty facilities.

3 Claims, 6 Drawing Figures

WATERCRAFT DOCKING

The Watercraft Dry Dock permits stowage of river and lake boats in a dry condition when not in use, and prevents damage to boat hulls under freezing conditions during the winter season without placing the boat ashore. It also provides a means of ready maintenance of boat hulls and propeller systems without removal of the craft from the lake. The dry dock consists of a framework which is raised and lowered by inflation or deflation of air bladders. The dry dock can be operated in conjunction with a marina or can be used as an individual dry dock wherever it can be anchored and a supply of compressed air is available. Boats can be docked and launched routinely from the dry dock.

Figure 1:
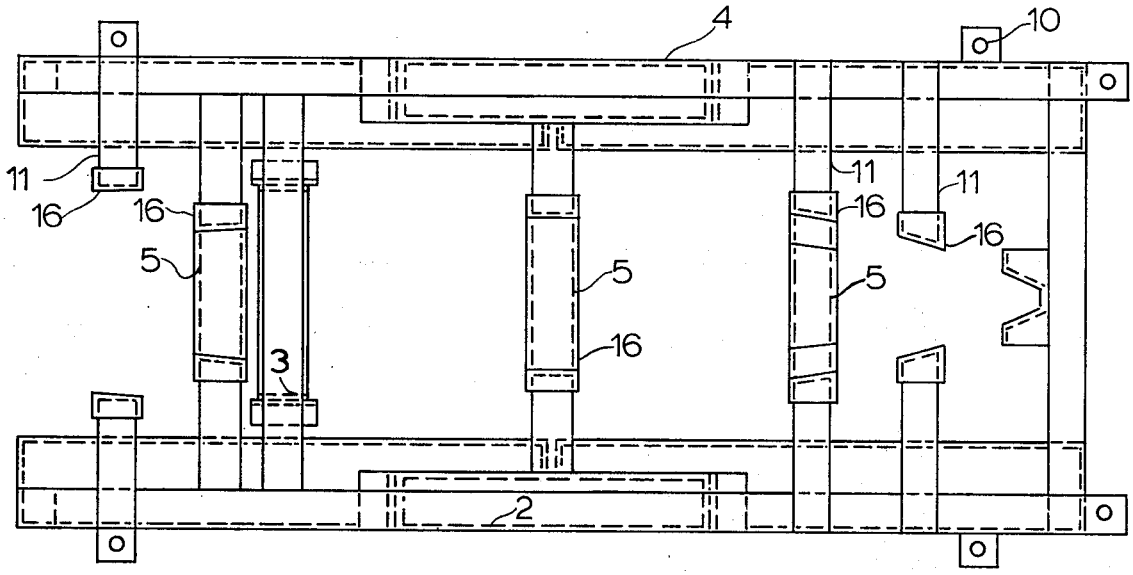
Figure 2:
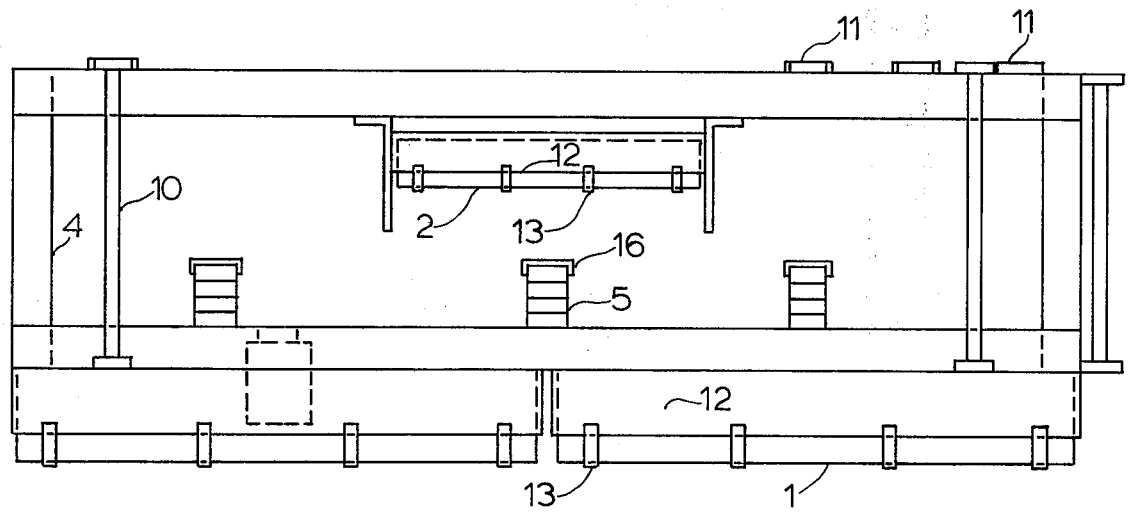
Figure 3:
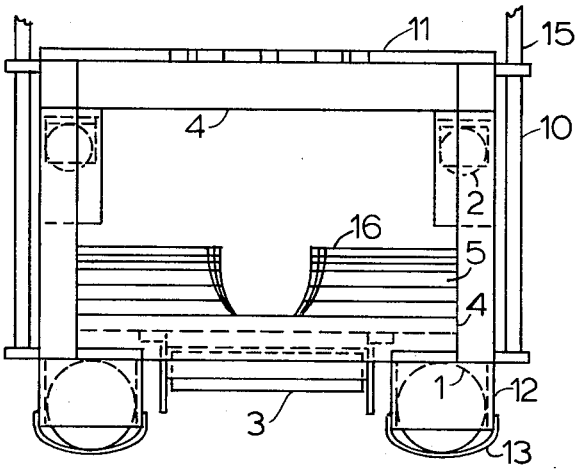
Figure 6:
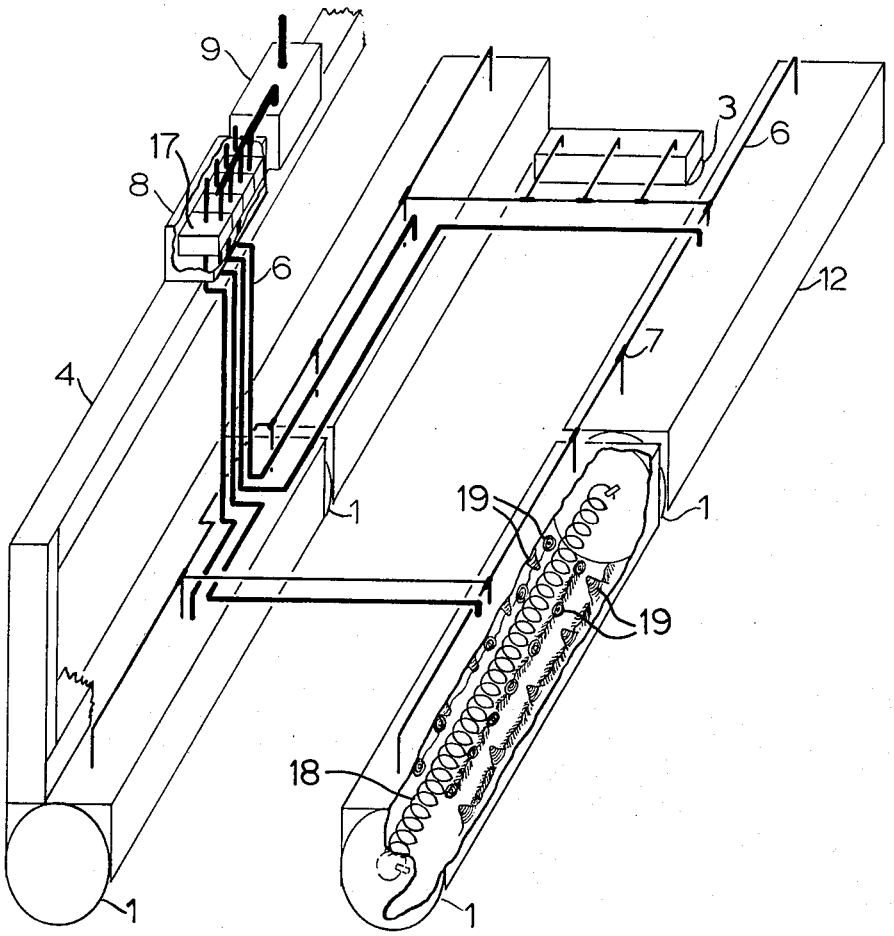

FIGS. 1 through 3 provide the plan, side, and rear elevation views of the dry dock, less the air hose and control system which is shown in FIG. 6.

Figure 4:
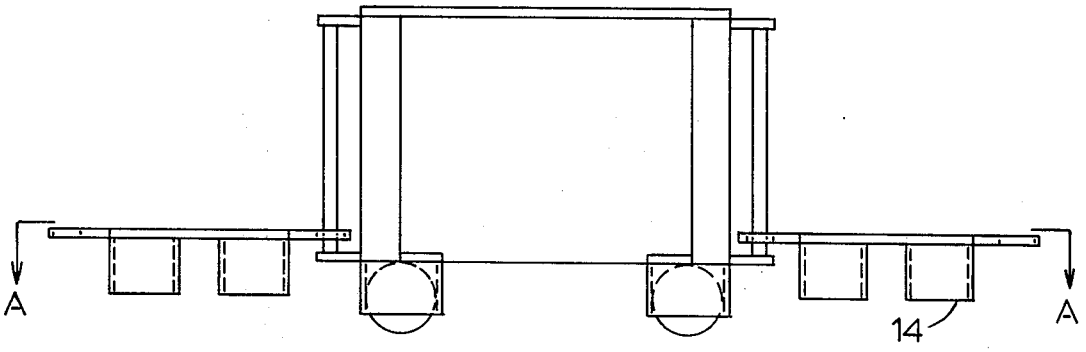
Figure 5:
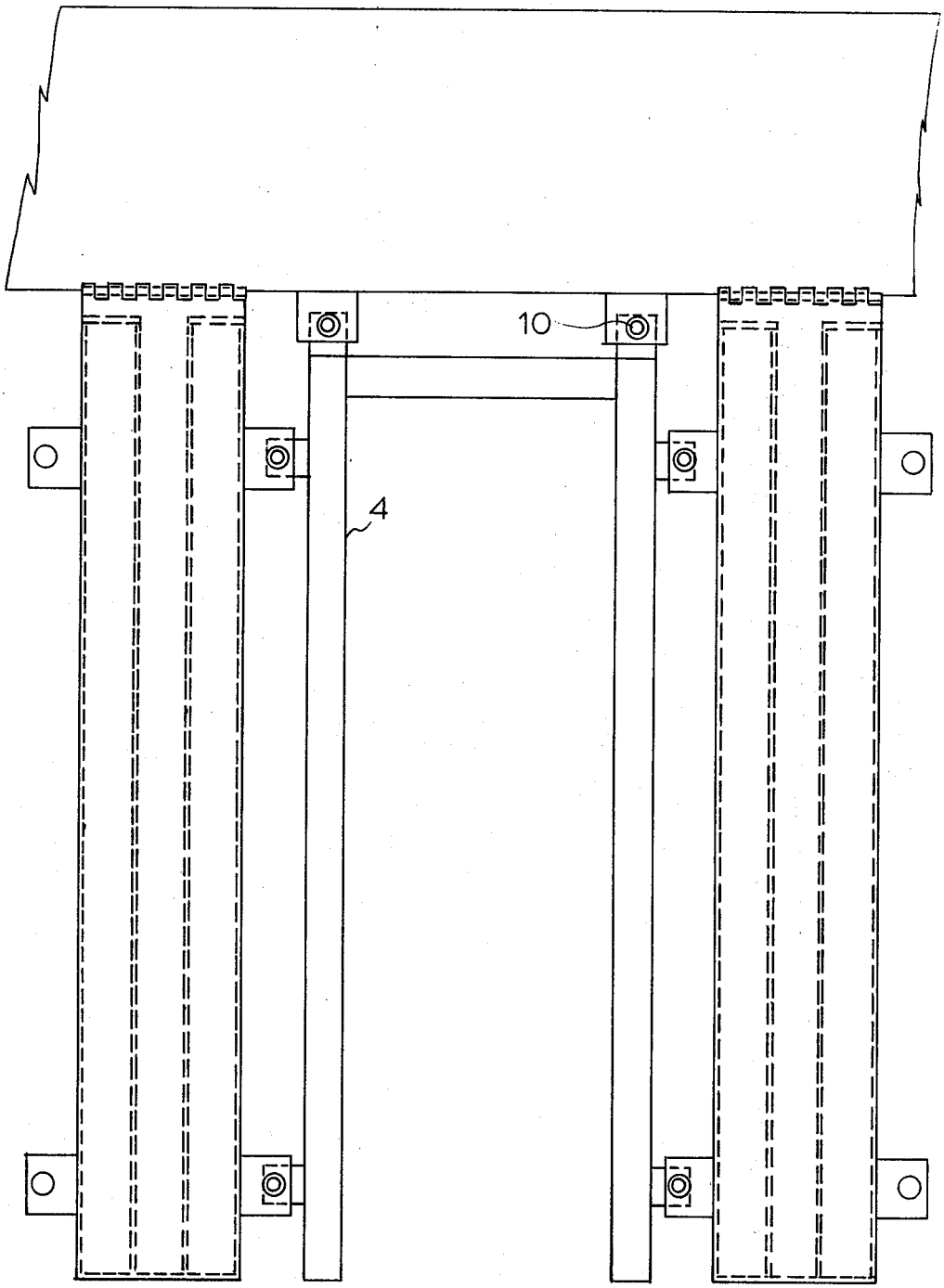

FIGS. 4 and 5 illustrate the operation of the dry dock within a marina. Components as designated in the drawings are as follow:

| | | | |
|---|---|---|---|
| 1. | Lift Bladders | 9. | Air Hose Reel |
| 2. | Flotation Bladders | 10. | Dry Dock Guide Rails |
| 3. | Trimmer Bladder | 11. | Boat Guides |
| 4. | Frame | 12. | Bladder Fenders |
| 5. | Supports | 13. | Bladder Retention Straps |
| 6. | Interconnecting Air Hose | 14. | Styrofoam Blocks |
| 7. | Air Hose Connectors | 15. | Cover Supports |
| 8. | Air Control | 16. | Bumpers |
| | | 17. | Air Control Valves |
| | | 18. | Coils |
| | | 19. | Semirigid Fingers |

In operation a boat is guided into the frame 4 of the dry dock and loosely positioned within the boat guides 11. Air is applied, using the air control 8, see FIG. 6, to the lift bladders 1, and the pressure is raised within the bladders until the keel of the boat is a short distance above the water's surface. To launch the boat, the exhaust valve of the air control 8 is opened, allowing air to escape into the atmosphere from the lift bladders. The dry dock settles into the water. Vertical motion of the boat within the dry dock is restricted to just that distance required to float the boat's keel from the boat support 5. This is accomplished by adjusting the flotation bladders 2 vertically in the frame to stop the descent of the dry dock when the boat hull is floated. The flotation bladders are contained within a frame which is bolted into flanges which provide an incremental adjustment through vertical rows of bolt holes provided for this purpose. Once set to a given boat, further adjustment should not be necessary. The flotation bladders, when properly adjusted, stabilize the dry dock so that the boat can be placed into, or removed from, the dry dock.

The trimmer bladder 3 serves to trim the boat/dry dock configuration for non-level flotation due to the location of the boat's center of gravity. The trimmer bladder is tied into the common air hose system, and is inflated and deflated at the same time as the lift bladders. The vertical location of the trimmer bladder is adjustable to provide trim control. Once set, it should not require additional adjustment. The location, as shown in the plan view, FIG. 1, is aft due to the probability that the center of gravity of most power boats will be aft. FIG. 3 depicts the vertical location of the trimmer bladder.

The air hose system interconnects the lift bladders to assure an even distribution of pressure within the bladders and a uniform lowering of the dry dock in case of a leaky bladder, see FIG. 6. The heavy lines depict the controlled air hose 6 which inflate and deflate the lift bladders, and run directly from each bladder to the air control 8 containing air control valves 17. Bladder air is exhausted through the top of the air control. Air from a source enters the air control from the air hose reel 9. The smaller lines, which provide both interconnection and intraconnection of the lift and trimmer bladders, equalize pressures within the bladders. A leak in a bladder will not cause uneven flotation, but will gradually refloat the boat. The flotation bladders are permanently inflated and have independent air valves which are not tied into the operating system.

To prevent the formation of trapped air within a collapsing bladder, all hose-to-bladder connections 7 are attached to the top side of the bladder and the bladder is constrained to keep the air hose connections in an upright position; also, open coils 18 or, as an alternate, semirigid fingers 19, attached to the inside of the bladder, serve to keep open an air passage which runs longitudinally the full length of the bladder. These coils or fingers provide a free air duct within the bladder, prevent entrapment of air into pockets, and help the bladders fill uniformly as air is applied. System stability is maintained through individual control of air flow to each of the four lift bladders. By observing the level condition of the dry dock and actuating the control valves, the dock can be raised or lowered in a level condition. The bleed hose connections between bladders provides a damping action on control response. Although all Figures depict cylindrical bladders, bladder design can provide more sophisticated shapes. A system containing two lift bladders will also provide a workable system.

The four-bladder system, with individual air control assures stable control during launch and recovery from and into the dry dock.

An over pressure, as compared to that required for summer operations, can be maintained in the bladders, offsetting changes in volume which occur with falling temperatures. Some elasticity in the bladders is preferable, but not essential to a successful system.

The boat supports 5 are located within the dry dock frame in a manner that provides a solid support for the boat, yet places the rear support sufficiently forward to clear the boat's propeller. The boat guides 11 provide sufficient clearance for easy entry into the dock; with the dry dock in the submerged condition, the guides are in ready view above the water. The guides are located just a little below the position on the boat hull that they will contact once the boat is raised. As the lateral dimension of most boat hulls increases in size from the keel up, the guides will be in closer proximity to the boat hull in a supported position within the dry dock than when the boat is guided into the frame.

The boat supports 5 illustrated in the side elevation drawing, FIG. 2, and the rear elevation of the dry dock, FIG. 3, are made up from sheaves which can be welded or bolted together. This provides a prefabricated assembly which can be readily tailored to a boat hull in the field by working the ends of individual sheaves which are then bolted or welded together to form the support. The surface contacted by the boat, that is the boat supports 5 and boat guides 11, are covered by a molded rubber (or other suitable material) bumper 16 which prevent abrasion to the boat hull. This is most clearly illustrated in the FIG. 1, plan view of the dry dock.

The dry dock rails 10 are illustrated in FIGS. 1, 2, and 3. The dry dock guide rails are pipe guides which constrain the dry dock to an area within a marina in the presence of surface motion. The pipe guides can be extended in length and with additional framework, not shown in the Figures, can provide the necessary support for a nonrigid covering over the upper portion of the dry dock for weather protection of the boat.

The bladder fenders 12, as shown in FIGS. 2 and 3, constrain the bladders to their intended position below the dry dock; and with the bladder retention straps 13, serve to retain bladder shape under load.

Fender straps are attached to the fenders by hooks and eyes on one end and hinged on the other to facilitate bladder replacement or repair.

The pressure within the bladder can be relatively low, numerically, being just sufficient to retain required bladder volume against the water and load pressure over a relatively large area. The fenders can be allowed to hinge inward toward the bladder, but are restrained by the bladder fender strap from moving away from the bladder. Therefore, the fender strap, or as an alternate a metal mesh, will see tension stresses only. Under conditions of ice formation during freezing conditions, the bladder and fenders respond by moving the distance of expansion as the water changes state from a liquid to a solid. The resiliency of the bladders prevents damage to the dry dock, and the boat is held safely above the zone where damage can occur.

FIG. 4 provides a rear elevation view of the dry dock frame occupying a berth formed by a marina. The marina walks are shown supported by blocks of styrofoam 14; although inflated bladders, with proper precautions, could serve to float the walks. The bracket with eye attached to the marina serves to guide the dry dock while in vertical motion; and allows limited, although adequate, motion in the remaining five dimensions.

Bracket lengths on the dry dock and marina are adequate to prevent contact between the dry dock and marina except through the guide rail with associated fittings.

FIG. 5 provides a plan view of the dry dock frame in the marina berth at the cross section AA of FIG. 4.

I claim:

1. A floating watercraft dry dock for providing a stable, dry stowage for watercraft in a raised position and an effective watercraft launch in a lowered position, comprising:

a. a rigid frame supported by a plurality of replaceable lift air bladders which are inflatably controlled, b. a plurality of flotation bladders mounted on the frame to control the submersion of the dry dock when it is to be lowered to launch a watercraft, c. a replaceable trimmer bladder mounted on the frame whereby the nonlevel flotation and trim of the dry dock due to an offset center of gravity can be corrected, d. dry dock guides, attached to the frame, to restrain the dry dock in a stable position and to allow the dry dock required vertical motion, e. boat supports and guides mounted to the dry dock frame, f. an air hose system comprising an air control, a take-up reel, air-control valves and connections to provide stabilized pressures to the lift bladders and to provide controlled inflation and deflation of the lift bladders, and g. bladder fenders and fender straps, attached to the frame to contain the lift bladders.

2. The dry dock of claim 1 in which the lift air bladders contain internally open coils which attach to the inner walls of the bladders and run longitudinally the length of the bladders.

3. The dry dock of claim 1 in which the lift air bladders contain semirigid fingers or ridges which attach to the inner walls of the bladder and run longitudinally the length of the bladder.

* * * * *